US009004872B2

(12) United States Patent
Aiello et al.

(10) Patent No.: US 9,004,872 B2
(45) Date of Patent: Apr. 14, 2015

(54) BEARING SURFACE COMBINED LOAD-LOCK SLOTS FOR TANGENTIAL ROTORS

(75) Inventors: Nicholas Aiello, New Haven, CT (US); Louis James Ruotolo, Woodbridge, CT (US); Uyen Phan, Granby, CT (US)

(73) Assignee: United Technologies Corporation, Hartford, CT (US)

( * ) Notice: Subject to any disclaimer, the term of this patent is extended or adjusted under 35 U.S.C. 154(b) by 806 days.

(21) Appl. No.: 13/184,744

(22) Filed: Jul. 18, 2011

(65) Prior Publication Data

US 2013/0022451 A1 Jan. 24, 2013

(51) Int. Cl.
*F01D 5/32* (2006.01)
*F01D 5/30* (2006.01)

(52) U.S. Cl.
CPC ..... *F01D 5/3038* (2013.01); *F01D 5/32* (2013.01)

(58) Field of Classification Search
CPC ..... F01D 5/303; F01D 5/32; F01D 5/323; F01D 5/326; F01D 5/3038
USPC ..... 416/220 R, 215, 216
See application file for complete search history.

(56) References Cited

U.S. PATENT DOCUMENTS

| | | | | |
|---|---|---|---|---|
| 3,042,368 | A * | 7/1962 | Cook | 416/216 |
| 7,419,360 | B2 * | 9/2008 | Chatel et al. | 416/215 |
| 2011/0116933 | A1 * | 5/2011 | Aiello | 416/215 |

* cited by examiner

*Primary Examiner* — Dwayne J White
*Assistant Examiner* — Joshua R Beebe
(74) *Attorney, Agent, or Firm* — Bachman & LaPointe, P.C.

(57) ABSTRACT

A system for assembling a turbine engine component has a disk having a groove, which groove has a bearing surface and an upper wall, at least one locking slot being positioned at an intersection of the bearing surface and the upper wall; each locking slot having a shaped surface; and at least one lock having a shape which matches and mates with the shaped surface of the locking slot; and said locking slots providing clearance to assemble blades into the disk.

6 Claims, 7 Drawing Sheets

BEARING SURFACE COMBINED LOAD-LOCK SLOTS FOR TANGENTIAL ROTORS

BACKGROUND

The present invention relates to a disk for use in a turbine engine component having a plurality of locking slots in a bearing surface and a system and method for assembling the turbine engine component.

Gas turbine engine have a plurality of compressors arranged in flow series, a plurality of combustion chambers, and a plurality of turbines arranged in flow series. The compressors typically include at least a high pressure compressor and a lower pressure compressor which are respectively driven by a high pressure turbine and a low pressure turbine. The compressors compress the air which has been drawn into the engine and provide the compressed air to the combustion chambers. Exhaust gases from the combustion chambers are received by the turbines which provide useful output power. Each compressor typically has a plurality of stages.

The main components of a typical tangential stage in a high pressure compressor are the disk, the blades, the ladder seals and the locks. The assembly sequence for a typical tangential stage is as follows. First, a ladder seal is assembled to the inner rail of the disk with a first slot of the ladder seal positioned directly over the loading slot in the disk. Second, a first blade is assembled through the ladder seal and through the loading slot in the disk. Then the blade and ladder seal are rotated around the circumference of the disk until the next slot of the ladder seal is positioned directly over the loading slot. In a similar fashion, the next blade is loaded and rotated. Once the blades have been completely loaded and rotated in the ladder seal segment, the lock is assembled through the load slot and rotated to the lock slot position and tightened. The lock prevents the circumferential motion of the blades, which insures that work will be done on the air and that the blades will not come back out through the load slot.

Since locking and loading slots form discontinuities in tangential rotor disks, they have been known to initiate thermal mechanical fatigue (TMF) cracking. The root cause of any TMF cracking is the thermal gradients that exist at certain flight points. One flight point may produce a cold bore and a hot rim, which would put the rim into compression. Another flight point may produce a hot bore and a cold rim which would put the rim into tension. This cyclic loading fatigues the disk. The locking and loading slots may make this condition worse by introducing stress concentrations due to the discontinuities.

SUMMARY

The present disclosure illustrates a system for assembling a turbine engine component which achieves a significant improvement in TMF life.

In accordance with the instant disclosure, there is provided a disk which broadly comprises a groove; said groove having a bearing surface and an upper wall; and at least one locking slot being positioned at an intersection of said bearing surface and said upper wall.

Further, in accordance with the present disclosure, there is provided a system for assembling a turbine engine component which broadly comprises a disk having a slot, said slot having a bearing surface, said bearing surface being provided with at least one locking surface for cooperating with a lock; said locking surface having a shape; and at least one lock having a shape which matches and mates with said shape of said locking surface.

Still further, in accordance with the present disclosure, there is provided a method for assembling a turbine engine component, which method broadly comprises providing disk having a groove, said groove having a bearing surface and an upper wall, at least one locking slot being positioned at an intersection of said bearing surface and said upper wall, and each said locking slot having a shaped surface; inserting a first blade into said groove at an angle with respect a final position; rotating said blade into said final position; inserting a lock into said groove; and rotating said lock until said lock engages said at least one locking slot.

Other details of the bearing surface combined load-lock slots for tangential rotors are set forth in the following detailed description and the accompanying drawings wherein like reference numerals depict like elements.

DETAILED DESCRIPTION

Figure 1:
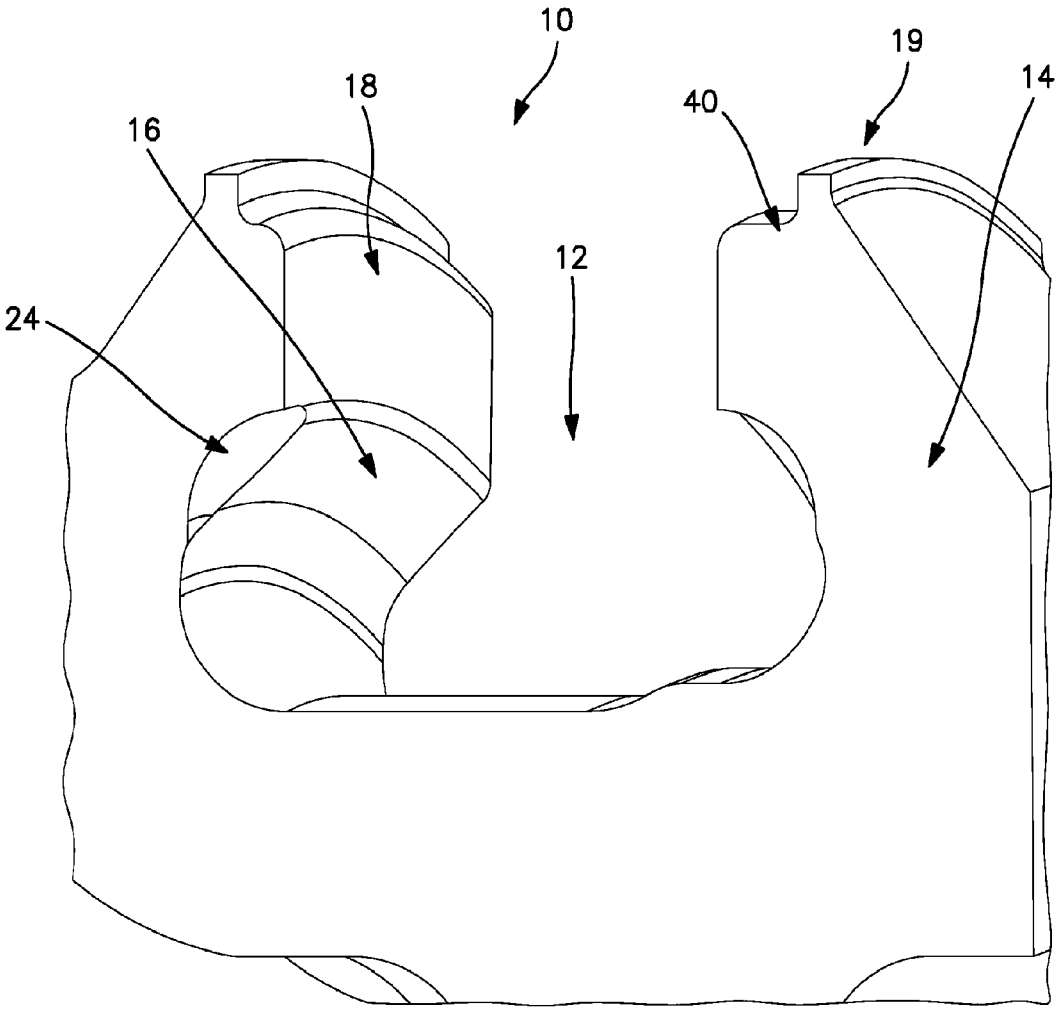
FIG. 1 is a sectional view of a turbine disk.
Figure 2:
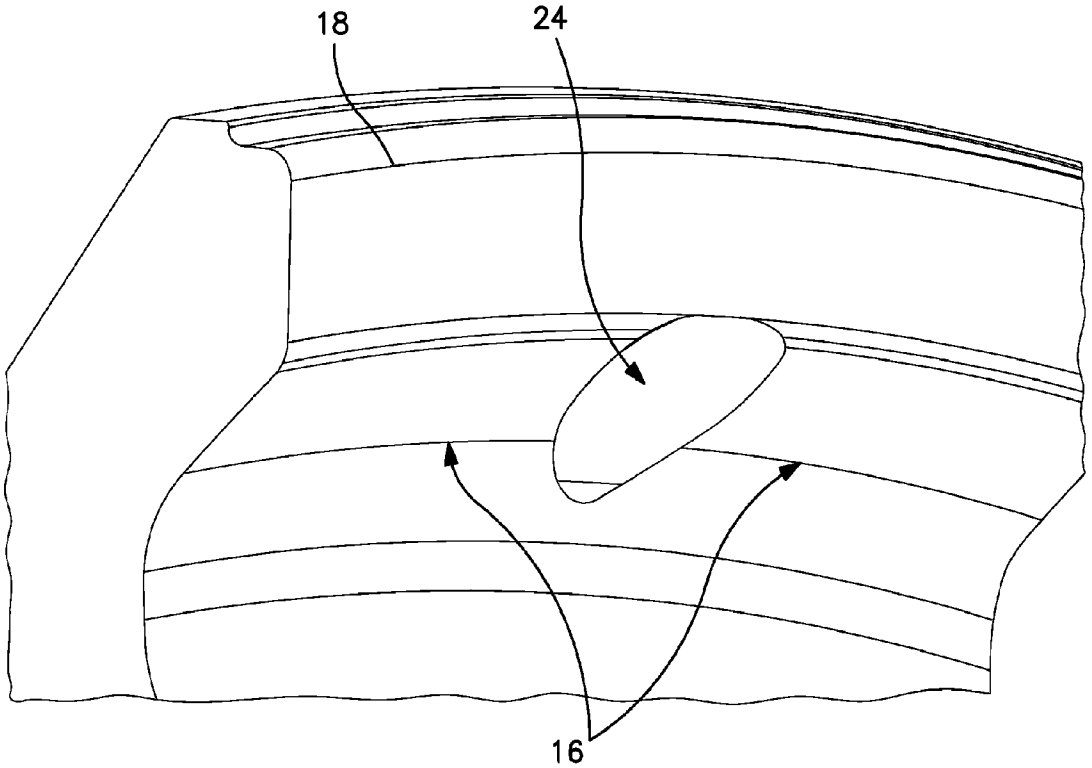
FIG. 2 illustrates a bearing surface with a load/lock slot in accordance with the instant disclosure.

Referring now to FIGS. 1 and 2, there is shown a disk 10 having a tangential groove 12 formed by sidewalls 14. The sidewalls 14 each have a conical bearing surface 16. The bearing surface 16 intersects an upper wall 18 forming the upper periphery of the groove 12. The upper wall 18 has an upper surface 19 upon which the platform 20 of a blade 22 rests at installation. The groove 12 is sized to allow for blade rotational assembly into the disk 10. The cold gap 23 at the blade platform 20 must be sufficient to allow for last blade installation.

In accordance with the present disclosure, a plurality of slots 24 are cut into the bearing surface 16 where the bearing surface 16 intersects the upper wall 18. The slots 24 are spaced at discrete locations along the length of the groove 12. By positioning the slots 24 in this area, associated stress concentrations are moved into a lower stress, lower temperature area, thereby increasing TMF life.

Figure 6:
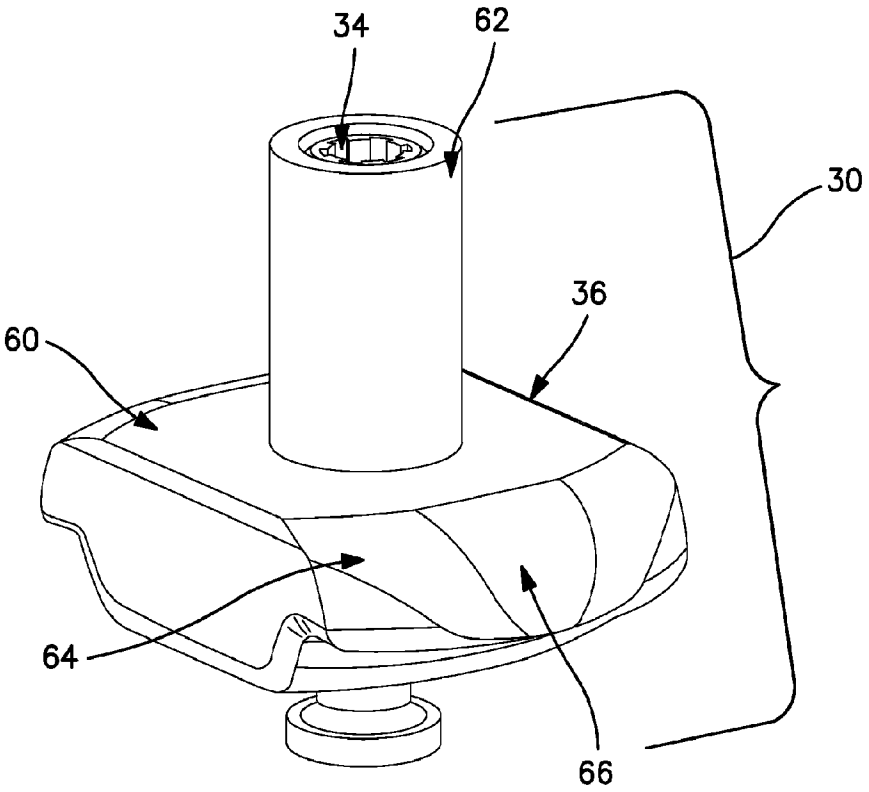
FIG. 6 is a view of a lock used in the assembly of the turbine engine component.

A plurality of locks 30 are provided to engage the slots 24. The locks 30 are spaced out along the length of the groove 12. Referring now to FIG. 6, each lock 30 has a lock body 36, consisting of a lower portion 60, a cylindrical element 62 joined to the lower portion, and a set screw 34. The cylindrical element 62 is used to rotate the lock 30 into position. The lower portion 60 is provided with two opposed end portions 64. Each end portion 60 has a shape which is designed to match the offset rotated radius shape of the slot 24 into which it fits. The offset rotated radius shape 64 of the lock provides self alignment of the lock body 36 and the adjacent blades 22. The body 36 of the lock 30 functions as bearing and shear area in both tangential and radial directions. If desired a relief feature 66 may be added to eliminate single point loading and eliminate contact in the high stress location of the slot 24.

Figure 3:
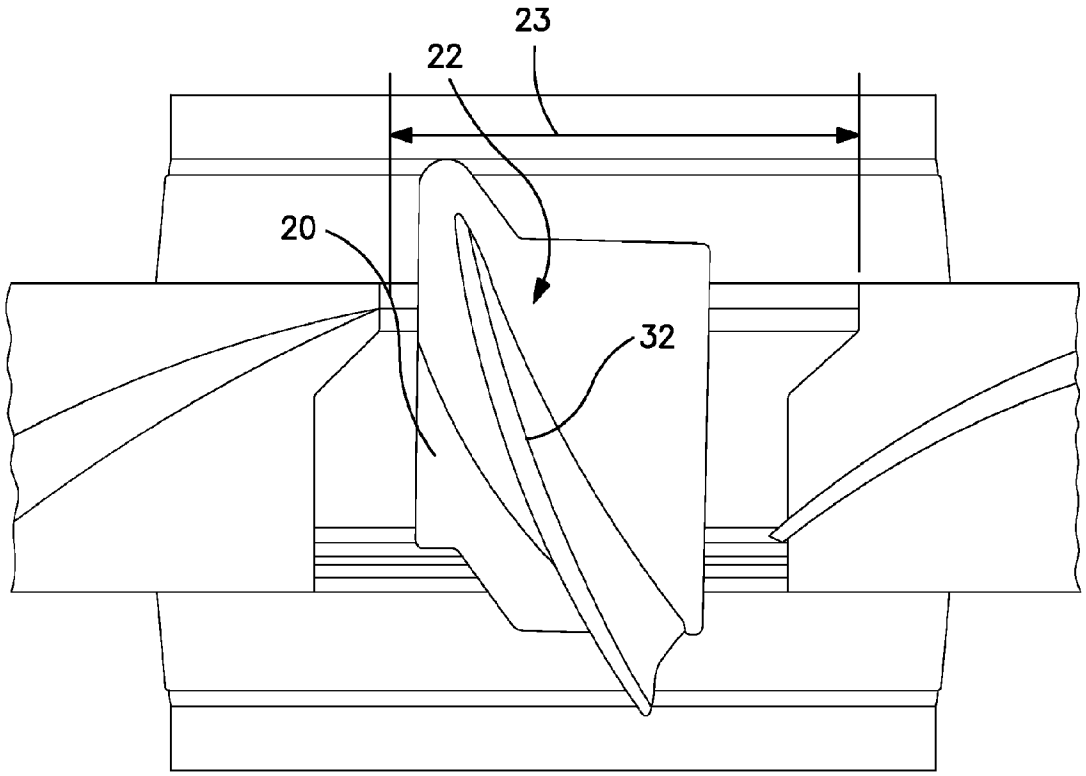
FIGS. 3-5 illustrate the installation of a blade.
Figure 4:
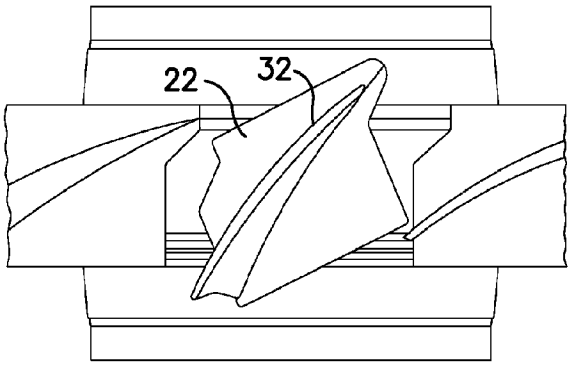
Figure 5:
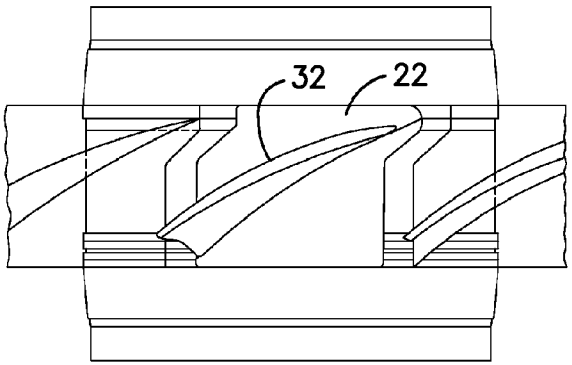

To assemble the turbine engine component to be used in the turbine engine, a first blade 22 is inserted into the tangential groove 12 at 90 degrees with respect to the blade's final position at load/lock slot location (see FIG. 3) and rotated into place at an installed radial distance from engine centerline (see FIGS. 4 and 5). The rotation of the blade 22 can be seen from the relative angle of the airfoil portion 32. The load/lock slot 24 provides clearance to pass blade root 23 high points during rotation. As can be seen from FIG. 7, each turbine blade 22 has a root portion 34. The root portion 34 sits within the groove 12, and is shaped to allow clearance for rotation during assembly.

After the first blade 22 has been installed and rotated into position, a lock 30 may be introduced into the groove 12. The lock 30 is rotated into position so that the end portions 64 each engage one of the slots 24.

Figure 7:
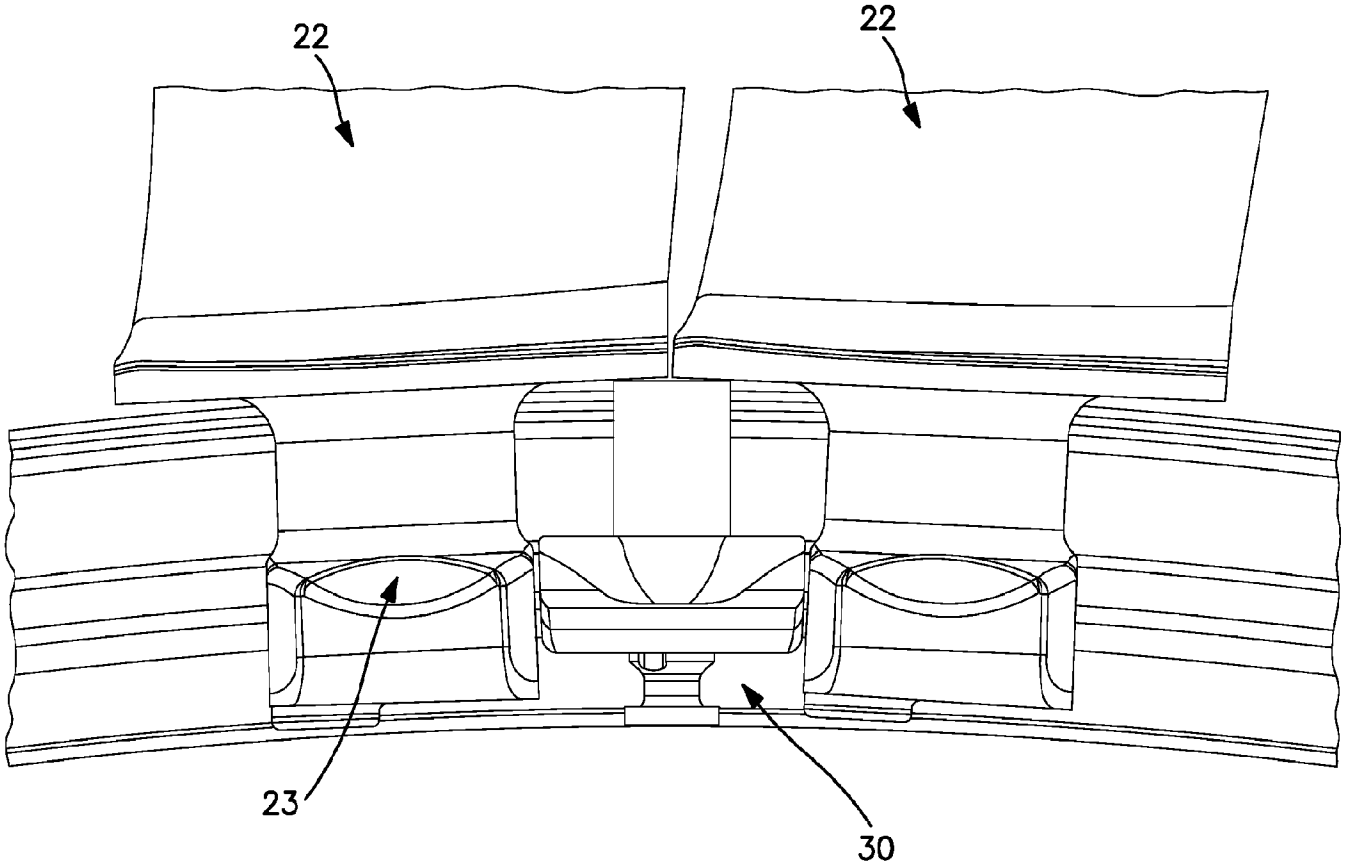
FIG. 7 is a sectional view of the root portion of the blade installed in the groove.
Figure 8:
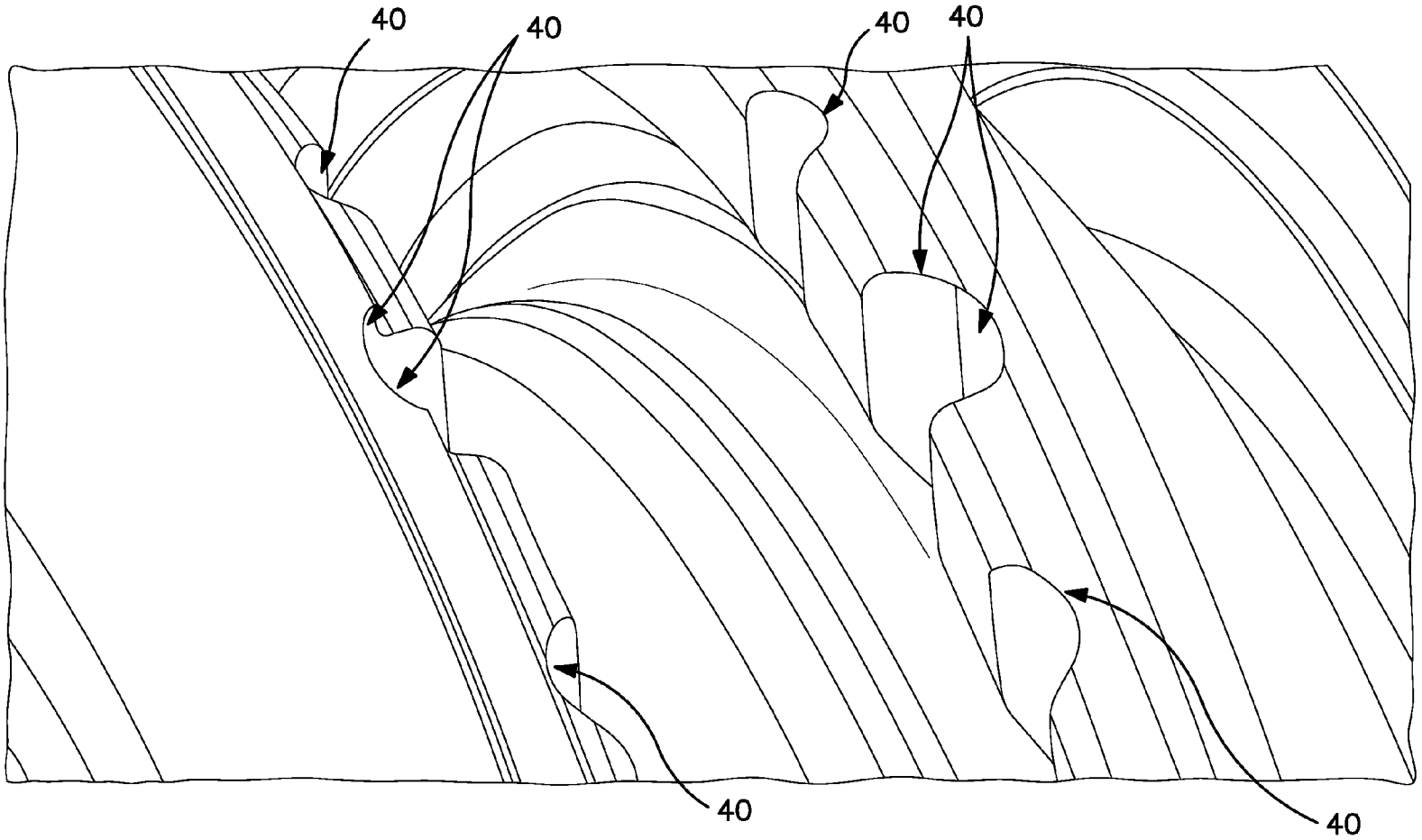
FIG. 8 (PRIOR ART)

After the lock is installed, a second blade 22 is introduced into the groove 12 and rotated into position. As shown in FIG. 7, the lock 30 sits between two adjacent blades 22. Additional blades 22 and locks 30 are installed until there is space for one more blade 22. At this point, the last blade 22 is installed and rotated into its final position.

One of the principal gains from the system disclosed herein is that TMF life is extended due to the movement of the slots into a lower stress and/or lower temperature region of the disk.

There has been provided herein a bearing surface combined load/lock slot for tangential rotors. While the specific embodiments have been described herein, other unforeseen alternatives, modifications, and variations may become apparent to those skilled in the art. It is intended to embrace those alternatives, modifications, and variations as fall within the broad scope of the appended claims.

What is claimed is:

1. A disk comprising a groove; said groove having a bearing surface and an upper wall, wherein said groove is a tangential groove and said tangential groove has a plurality of spaced locking slots; and at least one locking slot being positioned at an intersection of said bearing surface and said upper wall, said locking slot sized to allow for a blade rotational assembly into said disk, wherein said blade is insertable into said groove at 90 degrees with respect to a final position of said blade.

2. The disk of claim 1, wherein said locking slot has a shaped locking surface for cooperating with a mating portion of a lock.

3. A system for assembling a turbine engine component comprising a disk having a groove, said groove having a bearing surface and an upper wall, said groove being a tangential groove and a plurality of spaced locking slots being located along said groove, at least one locking slot being positioned at an intersection of said bearing surface and said upper wall; each said locking slot having a shaped surface; and at least one lock having a shape which matches and mates with said shaped surface of said locking slot, said locking slot sized to allow for a blade rotational assembly into said disk, wherein said blade is insertable into said groove at 90 degrees with respect to a final position of said blade.

4. A method for assembling a turbine engine component, comprising the steps of: providing a disk having a groove, said groove having a bearing surface and an upper wall, said groove being a tangential groove and a plurality of spaced locking slots being located along said groove, at least one locking slot being positioned at an intersection of said bearing surface and said upper wall, and each said locking slot having a shaped surface, said locking slot sized to allow for a blade rotational assembly into said disk wherein said blade is insertable into said groove at 90 degrees with respect to a final position of said blade; inserting a first blade into said groove at an angle with respect a final position; rotating said blade into said final position; inserting a lock into said groove; and rotating said lock until said lock engages said at least one locking slot.

5. The method according to claim 4, wherein said step of rotating said first blade comprises rotating said first blade 90 degrees.

6. The method according to claim 4, further comprising inserting a plurality of blades into said groove; and rotating said blades into a final position.

* * * * *